US006179959B1

(12) United States Patent
Kamano et al.

(10) Patent No.: US 6,179,959 B1
(45) Date of Patent: Jan. 30, 2001

(54) METHOD OF MAKING KENAF PULP

(75) Inventors: Yoshiaki Kamano, 18-5, Asahicho 1-chome, Nerima-ku, Tokyo (JP); Kunio Hiraga, Kanagawa-ken (JP)

(73) Assignee: Yoshiaki Kamano, Tokyo (JP)

( * ) Notice: Under 35 U.S.C. 154(b), the term of this patent shall be extended for 0 days.

(21) Appl. No.: 09/434,011

(22) Filed: Nov. 4, 1999

(30) Foreign Application Priority Data

Nov. 11, 1998 (JP) ..... 10-320811

(51) Int. Cl.[7] ..... D01C 1/00

(52) U.S. Cl. ..... 162/96; 162/96; 162/91; 162/97; 162/98; 162/99; 162/148

(58) Field of Search ..... 162/91, 95, 65, 162/96, 97, 98, 99, 148

(56) References Cited

U.S. PATENT DOCUMENTS 789,416 * 5/1905 Drewsen .
5,718,802 * 2/1998 Collier ..... 162/21

* cited by examiner

*Primary Examiner*—Peter Chin
*Assistant Examiner*—Mark Halpern
(74) *Attorney, Agent, or Firm*—Kaensaka & Takeuchi

(57) ABSTRACT

A method of making kenaf pulp of the present invention is formed of a first process of cutting at least one of core, rind, root and stalk of kenaf into chips with a predetermined length; a second process of crushing the chips of kenaf by mixing the chips with water in a crushing device; and a third process of boiling the crushed chips with water, so that fibers of kenaf are separated into make the kenaf pulp. Accordingly, the kenaf pulp can be formed without chemical processing.

9 Claims, 1 Drawing Sheet

METHOD OF MAKING KENAF PULP

BACKGROUND OF THE INVENTION AND RELATED ART STATEMENT

The present invention relates to a method of making kenaf pulp to make paper.

Kenaf is an annual plant belonging to a cotton rose in Malvaceae originating in West Africa, and has been attracted as a non-lumber pulp raw material instead of lumber pulp in view of protection of forests.

Conventionally, in order to make paper from pulped kenaf, core is peeled from kenaf and is crushed, and then, the crushed core is boiled with an alkali solution, such as sodium hydroxide or sodium hydroxide added with soap or the like.

However, it is not necessarily advantageous to process kenaf chemically with the alkali solution for making kenaf pulp in view of preparation of a chemical process equipment and waste liquid disposal equipment, and in view of environmental pollution resulting from waste liquid disposal.

Accordingly, an object of the present invention is to provide a method of making kenaf pulp easily to make paper without chemical processing.

Further objects and advantages of the invention will be apparent from the following description of the invention.

SUMMARY OF THE INVENTION

To achieve the above object, the present invention provides a method of making kenaf pulp, which comprises: cutting core, rind, root and stalk of kenaf into a certain length to form chips, respectively; crushing the chips by mixing the chips with water in crushing means; and boiling the crushed chips with water.

When the crushed chips of kenaf are boiled with water, fibers of kenaf are separated into pulp fibers.

Also, in the first process, stalk of kenaf is separated into core and rind before cutting kenaf into the chips.

Further, the chips processed in the method can be formed of one of the rind, core, stalk and root, or can be formed of a mixture of the rind and core, or a mixture of the rind, core and root.

DETAILED DESCRIPTION OF PREFERRED EMBODIMENTS

Figure 1:
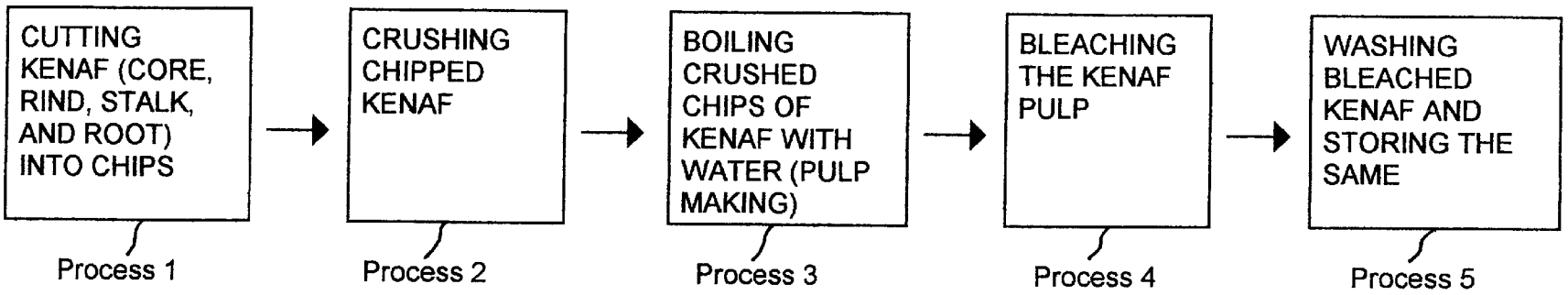
FIG. 1 is a diagram showing processes of making kenaf pulp according to the present invention.

A method of making kenaf pulp according to the present invention will be explained step by step while using tools suitable for education or training. However, the method of the invention is applicable to industrialization if the respective processes are gathered as a set of equipments in a factory scale.

Hereinafter, a method of making pulp from kenaf will be explained with reference to a diagram of FIG. 1 showing the processes.

Process 1 is a process of making kenaf chips. In the process 1, kenaf, which is cut off at a stalk when fully matured, is peeled, and separated into rind and core. Then, the core and rind are cut into the same length of approximately 1 cm by a cutting tool, such as scissors and cutting knife, in order to make kenaf chips.

Also, in case of kenaf which has been left in a room for about one month to be dried, kenaf is cut into approximately 30 cm with a saw or the like, and peeled with a knife or the like to be separated into rind and core. The rind is cut into a predetermined length, for example, a length of about 1 cm, to make kenaf chips. On the other hand, the core is tapped and separated into small pieces with a wooden hammer to make chips.

Further, stalk is cut, as it is, into a certain length to make chips. Also, root cut off from the stalk is washed with water, or washed and dried, and then cut into a predetermined length to make chips.

Process 2 is a process of crushing chipped kenaf. In the process 2, the core, rind, root and stalk cut into the chips in the process 1 are respectively put into separate mixers or blenders. Alternatively, the core and rind, or the core, rind and root are adequately mixed, and a mixture of the core and rind or the mixture of the core, rind and root can be put into the mixer.

Then, water (tap water can be used) is poured into the mixer, and the kenaf chips are mixed well with water and crushed by operating the mixer. In this mixing operation, cold water is preferable than warm water.

Process 3 is a process of boiling the crushed chips of kenaf, i.e. pulp making process. In the process 3, crushed chips in the process 2 are put into a stainless or enameled pan, and then water is poured into the pan until the crushed chips of kenaf are soaked in or covered with water. Then, the crushed chips are boiled with water in the pan. By boiling the crushed chips with water, fibers of kenaf are separated into pulp fibers.

Time for boiling kenaf in water is preferably 3 hours or so. After boiling kenaf in water is finished, boiled kenaf is cooled naturally. Then, water in the pan is thrown away, and the fibers of kenaf is put into a cloth bag and washed with water.

Making kenaf pulp is finished in the process 3. Hereunder, preparatory processes for making paper by using kenaf pulp are explained.

Process 4 is a process of bleaching the kenaf pulp or fibers boiled with water. In the process 4, after washing of the kenaf pulp or fibers with water is finished in the process 3, water is well drained. Then, the kenaf pulp in the bag or kenaf fibers taken out from the bag are soaked in a bleaching liquid including a bleaching agent to be bleached there at. As a bleaching agent, a bleaching agent for home use can be used, and the bleaching liquid is prepared by adding the bleaching agent to water, wherein the ratio of the bleaching agent to water is 1 to 1, or 1 to 2. Then, the kenaf pulp is soaked in the bleaching fluid prepared as described above at a room temperature for 5 to 8 hours. The bleaching liquid may be diluted with water if necessary. Time for bleaching the kenaf pulp or fibers may be decided by considering the degree of bleaching.

Process 5 is a process of storing the pulped kenaf. The pulped kenaf bleached in the process 4 is taken out from the bag and put into a container with fine mesh to wash the pulped kenaf or fibers in water thoroughly. Thereafter, the pulped kenaf is squeezed into a lump or block. The lump of the squeezed kenaf is stored in a refrigerator, or the lump of the squeezed kenaf is separated and dried, and then stored.

Regarding the kenaf mixture in the process 2, the kenaf pulp made from rind of kenaf and the kenaf pulp made from core of kenaf are considerably different in quality when paper is prepared in a paper making process. In case of the pulp exclusively made of rind, paper made therefrom has a rough surface and much strength. On the other hand, in case of the pulp exclusively made of core, paper made therefrom has a smooth surface and is suitable for writing. In case of the pulp made of a mixture of rind and core, paper made therefrom has an intermediate property or quality which is between the quality of paper made of rind pulp and the quality of paper made of core pulp.

In case of making paper by using the kenaf pulp made as described above, for example, dried kenaf pulp, starch as a binder, and water are stirred in a mixer. The stirred pulp liquid is put into a paper making trough to make a sheet of paper. This is an example of making paper, and the kenaf pulp may be used as a paper making material in the conventional paper-making method.

According to the present invention, it is possible to make kenaf pulp simply by boiling kenaf with water without chemical processing as in the conventional method in which sodium hydroxide or sodium hydroxide added with soap is used.

While the invention has been explained with reference to the specific embodiments of the invention, the explanation is illustrative and the invention is limited only by the appended claims.

What is claimed is:

1. A method of making kenaf pulp, comprising:

a first process of cutting kenaf, including root of the kenaf into chips with a predetermined length, a second process of crushing the chips by mixing the chips with water in crushing means, and a third process of boiling crushed chips with water without chemicals so that fibers of the chips of the kenaf are separated into, pulp fibers.

2. A method of making kenaf pulp according to claim 1, wherein the chips are formed of a stalk of the kenaf.

3. A method of making kenaf pulp according to claim 1, wherein the first process further includes separating a stalk of the kenaf into a core and rind before cutting the kenaf into the chips.

4. A method of making kenaf pulp according to claim 3, wherein the chips are formed of the core.

5. A method of making kenaf pulp according to claim 3, wherein the chips are formed of the rind.

6. A method of making kenaf pulp according to claim 3, wherein the chips are formed of the core and rind.

7. A method of making kenaf pulp, comprising:

a first process including separating kenaf into a stalk and root, separating the stalk into a core and rind, and cutting the root, core and rind into chips with a predetermined length, a second process of crushing the chips of the root, core and rind by mixing the chips with water in crushing means, and a third process of boiling the chips of the root, core and rind crushed by the crushing means with water so that fibers of the chips of the kenaf are dissolved to form kenaf pulp.

8. A method of making kenaf pulp according to claim 7, further comprising a fourth process of bleaching the kenaf pulp after the third process of boiling the chips with water.

9. A method of making kenaf pulp according to claim 8, further comprising a fifth process of washing the bleached kenaf pulp with water after the fourth process of bleaching the kenaf pulp.

* * * * *